United States Patent [19]

Resch, III

[11] Patent Number: 4,847,659

[45] Date of Patent: Jul. 11, 1989

[54] APPARATUS FOR CONTROLLING TONER REPLENISHMENT IN ELECTROSTATOGRAPHIC PRINTER

[75] Inventor: William A. Resch, III, Pittsford, N.Y.

[73] Assignee: Eastman Kodak Company, Rochester, N.Y.

[21] Appl. No.: 52,632

[22] Filed: May 21, 1987

[51] Int. Cl.[4] ..... G03G 15/00

[52] U.S. Cl. ..... 355/202; 355/208; 355/246

[58] Field of Search ..... 355/14 E, 14 D, 14 CH

[56] References Cited

U.S. PATENT DOCUMENTS

| | | | |
|---|---|---|---|
| 3,529,546 | 9/1967 | Kollar . | |
| 3,674,353 | 7/1972 | Trachtenberg . | |
| 4,141,645 | 2/1979 | Reid . | |
| 4,239,374 | 12/1980 | Tatsumi et al. | 355/14 E |
| 4,318,610 | 3/1982 | Grace | 355/14 CH X |
| 4,413,264 | 11/1983 | Cruz-Uribe et al. . | |
| 4,432,634 | 2/1984 | Tabuchi | 355/14 D |
| 4,492,179 | 1/1985 | Folkins et al. . | |
| 4,607,944 | 8/1986 | Rushing . | |
| 4,610,532 | 9/1986 | De Schamphelaere et al. | 355/14 D |
| 4,707,748 | 11/1987 | Ohtsuka et al. | 355/14 D X |

*Primary Examiner*—Arthur T. Grimley
*Assistant Examiner*—Edward Pipala
*Attorney, Agent, or Firm*—Milton S. Sales

[57] ABSTRACT

An electrostatographic machine replenishes the toner in a developer mix proportionally in response to a toner depletion signal having a value indicative of the rate of toner usage. A second signal is produced having a value proportional to toning contrast; and the contrast of proportionality between toner replenishment and the depletion signal is adjusted in response to the second signal value. The toner depletion signal may be indicative of the number of character print signals applied to a print head; the characters preferably being pixels to be toned.

11 Claims, 3 Drawing Sheets

APPARATUS FOR CONTROLLING TONER REPLENISHMENT IN ELECTROSTATOGRAPHIC PRINTER

BACKGROUND OF THE INVENTION

1. Field of the Invention

This invention relates to the field of electrostatography and, more particularly, to improvements in apparatus for controlling toner replenishment.

2. Decription of Prior Art

In electrostatography, electrostatic images formed on a dielectric recording element are rendered visible via the application of pigmented, thermoplastic particles known as toner. Typically, such toner forms part of a two-component developer mix consisting of the toner particles and magnetically-attractible carrier particles to which the toner particles adhere via triboelectric forces. During the development process, the electrostatic forces associated with the latent image act to strip the toner particles from their associated carrier particles, and the partially denuded carrier particles are returned to a reservoir.

It is well known in the art to continuously monitor the toner concentration in an electrostatographic developer mix and to replenish the mixture with toner when the concentration thereof falls below a predetermined level. Such a toner concentration monitor can be easily calibrated to compensate for toner depletion from the development system regardless of cause. Its significant drawback is that it is relatively slow to respond to abrupt changes in toner depletion rate, such as occasioned by a change in the image content of the documents being printed from ones having little image information thereon, to ones having large solid or continuous tone image areas. Typically, several minutes will elapse before the toner concentration is restored to a level at which copies of a desired image density can be obtained.

It is also known in the art to continuously monitor toner depletion from an electrostatographic development station by monitoring the amount of toner applied to the recording member during development. For example, in the commonly assigned U.S. Pat. No. 3,674,353 issued to Trachtenberg, a pair of induction plates, positioned adjacent the recording member on the upstream and downstream sides of the development station, function to sense the overall charge on the recording member before and after development. The difference in charge induced on the plates by the passage of the undeveloped and developed charge patterns has been found to be an accurate measure of the quantity of toner depleted from the development station. A toner depletion signal, proportional to the difference in charge induced on the induction plates, is used to control toner replenishment.

Another method for continuously monitoring toner depletion from a development station is useful in electronic printers. The replenishing rate is adjusted in response to the number of character print signals applied to the print head. The print signals may be in character code and a statistical average take-out rate used to estimate toner depletion, or the signals may be picture elements (pixel) signals. See for example U.S. Pat. Nos. 3,529,546 and 4,413,264.

While such toner depletion monitors are quicker to respond than are toner concentration monitors, their use for controlling toner replenishment has certain disadvantages. For example, any toner depletion, aside from that caused by image development (e.g. dusting and other losses), is not sensed by such a monitor and, hence cannot be accounted for by replenishment. Nor can such a monitor detect and cure inaccuracies or defects in the toner replenishment process. In short, toner depletion monitors are difficult, at best, to calibrate for precise control of toner replenishment.

SUMMARY OF THE INVENTION

In view of the foregoing discussion, an object of this invention is to provide a toner replenishment control apparatus which overcomes the aforementioned disadvantages of prior art systems.

An electrostatographic machine includes means for contacting an electrostatic image-bearing member with a mix of toner and carrier particles for development, and means for replenishing the toner in the mix. According to the present invention, a toner depletion signal is produced having a value indicative of the rate of toner usage. A replenishment controller actuates toner replenishment proportionally in accordance with the value of the depletion signal. A second signal is produced having a value proportional to toning contrast; and the constant of proportionallity between the toner depletion signal and the replenishment is adjusted according to the second signal.

According to a preferred embodiment of the present invention, the toner depletion signal is proportional to the number of character print signals applied to a print head; the characters preferably being pixels to be toned.

According to another embodiment of the present invention, image areas of a recording member are substantially uniformly charged to a primary voltage and imagewise exposed to produce discrete latent charge images for development, the development bias, the exposure level, and the primary voltage being process control parameters. Means are provided for controlling at least one of the process control parameters for a given image area to adjust the maximum output image density $D_{max}$. A toner depletion signal is proportionally converted to a toner replenishment control signal; the constant of proportionality of the converting means being adjusted in response to the difference between the value of at least one of the controlled process control parameters and a predetermined target value.

The invention and its various advantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein.

DESCRIPTION OF THE PREFERRED EMBODIMENT

Figure 1:
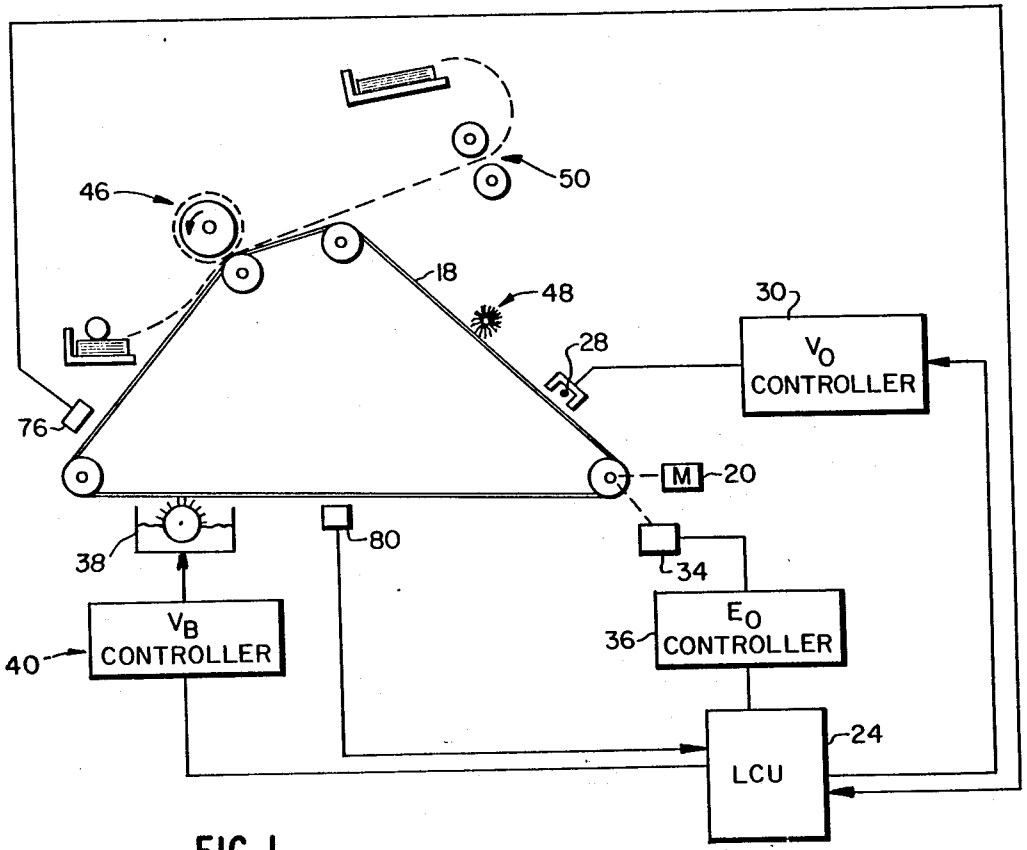
FIG. 1 is a schematic showing a side elevational view of an electrostatograhic machine in accordance with a preferred embodiment of the invention.

To facilitate understanding of the foregoing, the following terms are defined:

$V_B$=Development station electrode bias.

$V_0$=Primary voltage (relative to ground) on the photoconductor just after the charger. This is sometimes referred to as the "initial" voltage.

$V_F$=Photoconductor voltage (relative to ground) just after exposure.

$E_0$=Light produced by the print head.

E=Actual exposure of photoconductor. Light $E_0$ produced by the print head illuminates the photoconductor and causes a particular level of exposure E of the photoconductor.

Contrast and density control is achieved by the choice of the levels of $V_0$, $E_0$, and $V_B$. For a detailed explanation of the theory of printer contrast and exposure control by controlling initial voltage, exposure, and bias voltage, reference may be made to the following articles: Paxton, Electrophotographic Systems Solid Area Response Model, 22 Photographic Science and Engineering 150 (May/June 1978).

Another term used herein is "toning contrast", by which is meant the ratio of the output maximum density $D_{max}$ to the absolute value of the difference between $V_B$ and $V_F$ corresponding to a region of maximum density.

A moving recording member such as photoconductive belt 18 is driven by a motor 20 past a series of work stations of the printer. A logic and control unit (LCU) 24, which has a digital computer, has a stored program for sequentially actuating the work stations.

For a complete description of the work stations, see commonly assigned U.S. Pat. No. 3,914,046. Briefly, a charging station 28 sensitizes belt 18 by applying a uniform electrostatic charge of predetermined primary voltage $V_0$ to the surface of the belt. The output of the charger is regulated by a programmable controller 30, which is in turn controlled by LCU 24 to adjust primary voltage $V_0$.

At an exposure station 34, projected light from a write head dissipates the electrostatic charge on the photoconductive belt to form a latent image of a document to be copied or printed. The write head preferably has an array of light-emitting diodes (LED's) or other light source for exposing the photoconductive belt picture element (pixel) by picture element with an intensity regulated by a programmable controller 36 as determined by LCU 24.

Travel of belt 18 brings the areas bearing the latent charge images into a development station 38. The development station has one (more if color) magnetic brush in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40.

A transfer station 46 and a cleaning station 48 are both fully described in commonly assigned U.S. patent application Ser. No. 809,546, filed Dec. 16, 1985. After transfer of the unfixed toner images to a receiver sheet, such sheet is transported to a fuser station 50 where the image is fixed.

Logic and Control Unit (LCU)

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
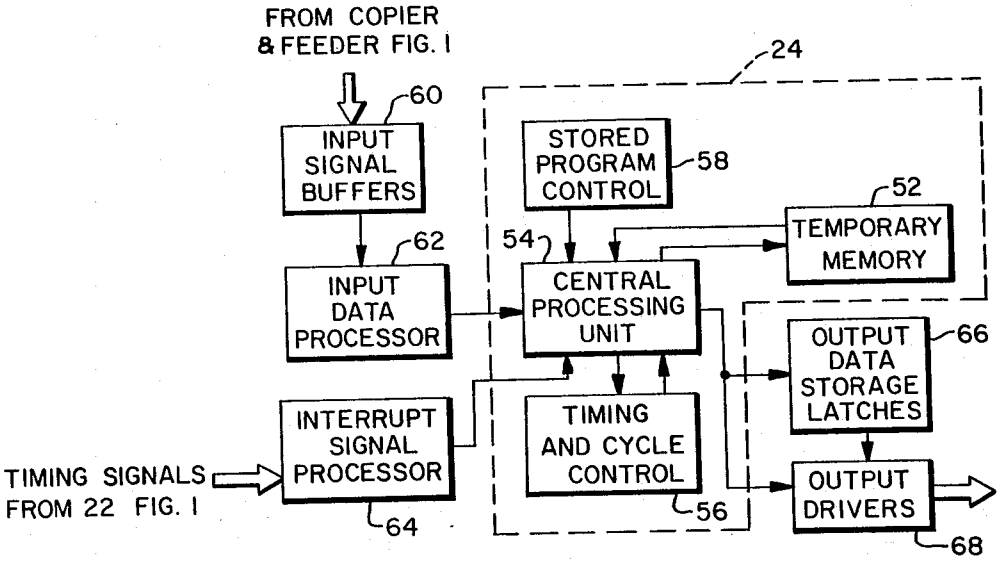
FIG. 2 is a block diagram of the logic and control unit shown in FIG. 1.

Referring to FIG. 2, a block diagram of a typical LCU 24 is shown. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Feedback Control

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 18, as is well known in the art. The densitometer is intended to insure that the transmittance or reflectance of a toned patch on the belt is maintained. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of an estimate of toned density. This signal may be used to adjust $V_0$, $E_0$, or $V_B$; and, as explained below, to assist in the maintenance of the proper concentration of toner particles in the developer mixture.

Figure 3:
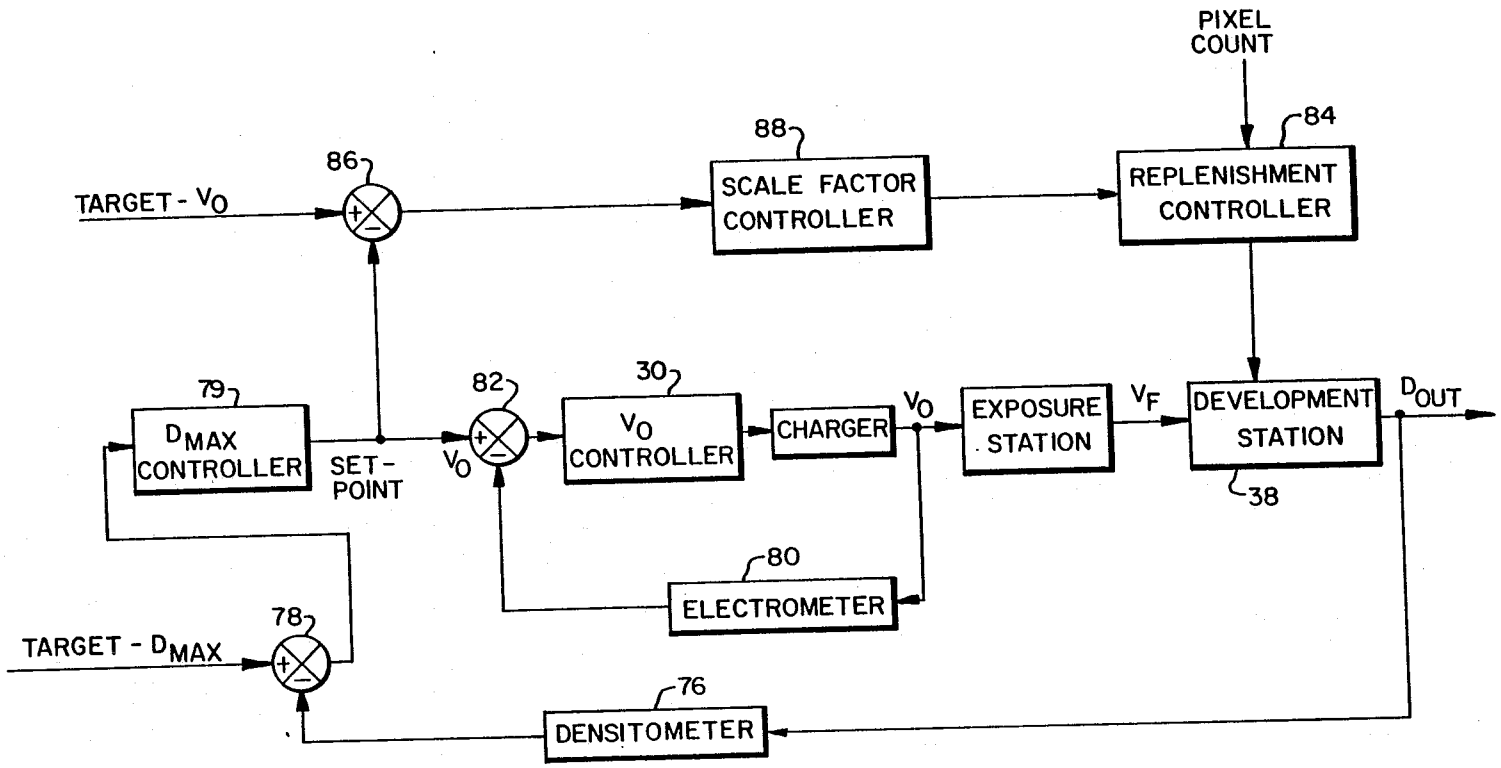
FIG. 3 is a diagram of the process for deriving a development station replenishment control signal for the electrostatographic machine of FIG. 1.

In the preferred embodiment illustrated in FIG. 3, the density signal is used to control primary voltage $V_0$. The output of densitometer 76, upon being suitably amplified, is compared at 78 to a reference signal value "Target $D_{max}$" representing a desired maximum density output level.

The output of comparator 78 may be fed to standard proportional and integral (PI) controller 79 which produces an output signal having a first component proportional to its input and a second component proportional to the integral of its output. The integral term assures that there will be a zero steady-state error for any constant rate of toner depletion.

The output of PI controller 79 is referred to herein as the "Set-Point-$V_0$".

The actual post-charging film voltage $V_0$ is measured by an electrometer 80, and is compared to Set-Point $V_0$ at 82 to produce a signal for adjusting $V_0$ controller 30 to obtain proper density for the next frame. $V_0$ controller 30 is also of the proportional and integral type.

Replenishment

In FIG. 3, a proportional replenishment controller 84 receives a toner depletion signal indicative of the rate of toner usage. The usage signal may be an indication of the number of sheets printed or the number of characters, but preferably is a count of the number of pixels to be toned.

In the short term, replenishment controller 84 reacts proportionally to the pixel count, or other usage signal, to create a replenishment control signal. However, the constant of proportionallity may require occasional adjustment to prevent long term accumulated error from causing variations from acceptable toner concentration in the developer mix. Such error could result from inaccuracies, material life, or environmental effects.

Errors in the replenishment rate are determined by the toning contrast, such as any offset between the Set-Point-$V_0$ signal from $D_{max}$ controller 79 and a Target-$V_0$ signal, as determined by a comparator 86. A change in the Set-Point-$V_0$ value reflects a change in toning contrast (i.e., variation in $D_{out}$ from $D_{max}$). As Set-Point-$V_0$ travels away from Target-$V_0$, a scale factor controller 88 adjusts the value of the controller 84 constant of proportionallity relating the toner usage signal to the amount of toner expedited to be consumed.

Scale factor controller 88 is a proportional and integral (reverse) controller which fine tunes the constant of proportionallity used to convert pixel counts into toner utilization, while replenishment controller 84 is proportional-only (direct). The reverse action of controller 88 arises from the interpretation of a positive error signal at the output summing junction 86 as indicating a need to reduce the replenishment scale factor. As this is accomplished, the $V_0$ set point increases, and the error signal is reduced.

The invention has been described in detail with particular reference to preferred embodiments thereof but it will be understood that variations and modifications can be effected within the spirit and scope of the invention. For example, the algorithm of the preferred embodiment is suitable for computing a replenishment control signal based on primary voltage $V_0$ measurements. However, one might choose to use exposure parameter $E_0$ or development bias parameter $V_B$ rather than film voltage parameter $V_0$ measurements.

What is claimed is:

1. In an electrostatographic machine including (1) means for contacting an electrostatic image-bearing member with a mix of toner and carrier particles for development, and (2) means for replenishing the toner in the mix; the improvement comprising:

means for producing a toner depletion signal having a value indicative of the rate of toner usage;

means responsive to said depletion signal for actuating toner replenishing proportionally according to the value of said depletion signal;

means for producing a second signal having a value proportional to toning contrast; and means, responsive to said second signal value, for adjusting the constant of proportionallity between the rate of toner usage and the depletion signal value.

2. The improvement as defined in claim 1 wherein;

said machine further includes a print head and means to apply character print signals to said print head; and said toner depletion signal is proportional to the number of character print signals applied to the print head.

3. The improvement as defined in claim 2 wherein said characters are pixels to be toned.

4. In an electrostatographic machine including (1) means for substantially uniformly charging a recording member, having image areas, to a primary voltage; (2) means for imagewise exposing the charged recording member to produce discrete latent charge images; (3) means, including a biased electrode, for developing the latent charge images, the electrode bias, the exposure level, and the primary voltage being process control parameters; and (4) means for controlling at least one of the process control parameters for a given image area to adjust the maximum output image density $D_{max}$; the improvement comprising:

means for producing a toner depletion signal;

means for proportionally converting the depletion signal to a toner replenishment control signal;

means, for the given image area, for comparing the value of said at least one of the controlled process control parameters to a predetermined target value to produce a difference signal; and means for adjusting the constant of proportionallity of the converting means in response to the difference signal.

5. The improvement as defined in claim 4 wherein;

said machine further includes a print head and means to apply character print signals to said print head; and said toner depletion signal is proportional to the number of character print signals applied to the print head.

6. The improvement as defined in claim 5 wherein said characters are pixels to be toned.

7. The improvement as defined in claim 4 wherein said adjusting means is a proportional and integral controller.

8. In an electrostatographic machine including (1) means for substantially uniformly charging a recording member, having image areas, to a primary voltage, (2) means for imagewise exposing said member to produce discrete latent charge images for development, and (3) means for controlling the primary voltage to adjust the maximum output image density $D_{max}$; the improvement comprising:

means for producing a toner depletion signal;

means for proportionally converting the toner depletion signal to a toner replenishment control signal;

means, for the given image area, for comparing the primary voltage value to a predetermined target value to produce a difference signal; and means for adjusting the constant of proportionallity of the converting means in response to the difference signal.

9. The improvement as defined in claim 8 wherein;

said machine further includes a print head and means to apply character print signals to said print head; and said toner depletion signal is proportional to the number of character print signals applied to the print head.

10. The improvement as defined in claim 9 wherein said characters are pixels to be toned.

11. The improvement as defined in claim 8 wherein said adjusting means is a proportional and integral controller.

* * * * *